US006168372B1

(12) United States Patent
Greenwell

(10) Patent No.: US 6,168,372 B1
(45) Date of Patent: Jan. 2, 2001

(54) TOP LOAD, TOP FEED ARTICLE MAGAZINE

(75) Inventor: J. Daniel Greenwell, Florence, KY (US)

(73) Assignee: R. A. Jones & Co. Inc., Covington, KY (US)

( * ) Notice: Under 35 U.S.C. 154(b), the term of this patent shall be extended for 0 days.

(21) Appl. No.: 09/165,935

(22) Filed: Oct. 2, 1998

(51) Int. Cl.[7] ..... B65G 59/08
(52) U.S. Cl. ..... 414/801; 414/798.9; 493/316
(58) Field of Search ..... 414/798.9, 801; 493/316

(56) References Cited

U.S. PATENT DOCUMENTS

| | | | |
|---|---|---|---|
| 2,361,907 | 11/1944 | Baker et al. . | |
| 4,429,864 | 2/1984 | Scarpa et al. | 271/10 |
| 4,511,134 | 4/1985 | Hughes | 271/113 |
| 4,518,301 | 5/1985 | Greenwell . | |
| 4,582,315 | 4/1986 | Scarpa et al. | 271/150 |
| 4,596,545 | 6/1986 | Greenwell | 493/315 |
| 4,779,860 | 10/1988 | Scarpa | 271/110 |
| 4,869,486 | 9/1989 | Scarpa et al. | 271/3.1 |
| 4,934,682 | 6/1990 | Rece et al. | 271/3.1 |
| 5,131,899 * | 7/1992 | Nagahashi et al. | 414/798.9 X |

FOREIGN PATENT DOCUMENTS

| | | |
|---|---|---|
| 0 562 954 A1 | 9/1993 | (EP) . |
| 2 211 490 | 7/1989 | (GB) . |

* cited by examiner

*Primary Examiner*—Janice L. Krizek
(74) *Attorney, Agent, or Firm*—Wood, Herron & Evans, LLP

(57) ABSTRACT

A blank feeder includes a blank stack with blanks inclined forwardly in a magazine section and rearwardly in a discharge section so the stack has two effective top ends, one for supply and one for feeding. Blank inclination is reversed intermediate the stack ends without separating blanks in the stack during inclination reversal. Methods and apparatus are disclosed.

21 Claims, 3 Drawing Sheets

TOP LOAD, TOP FEED ARTICLE MAGAZINE

BACKGROUND OF THE INVENTION

Figure 1:
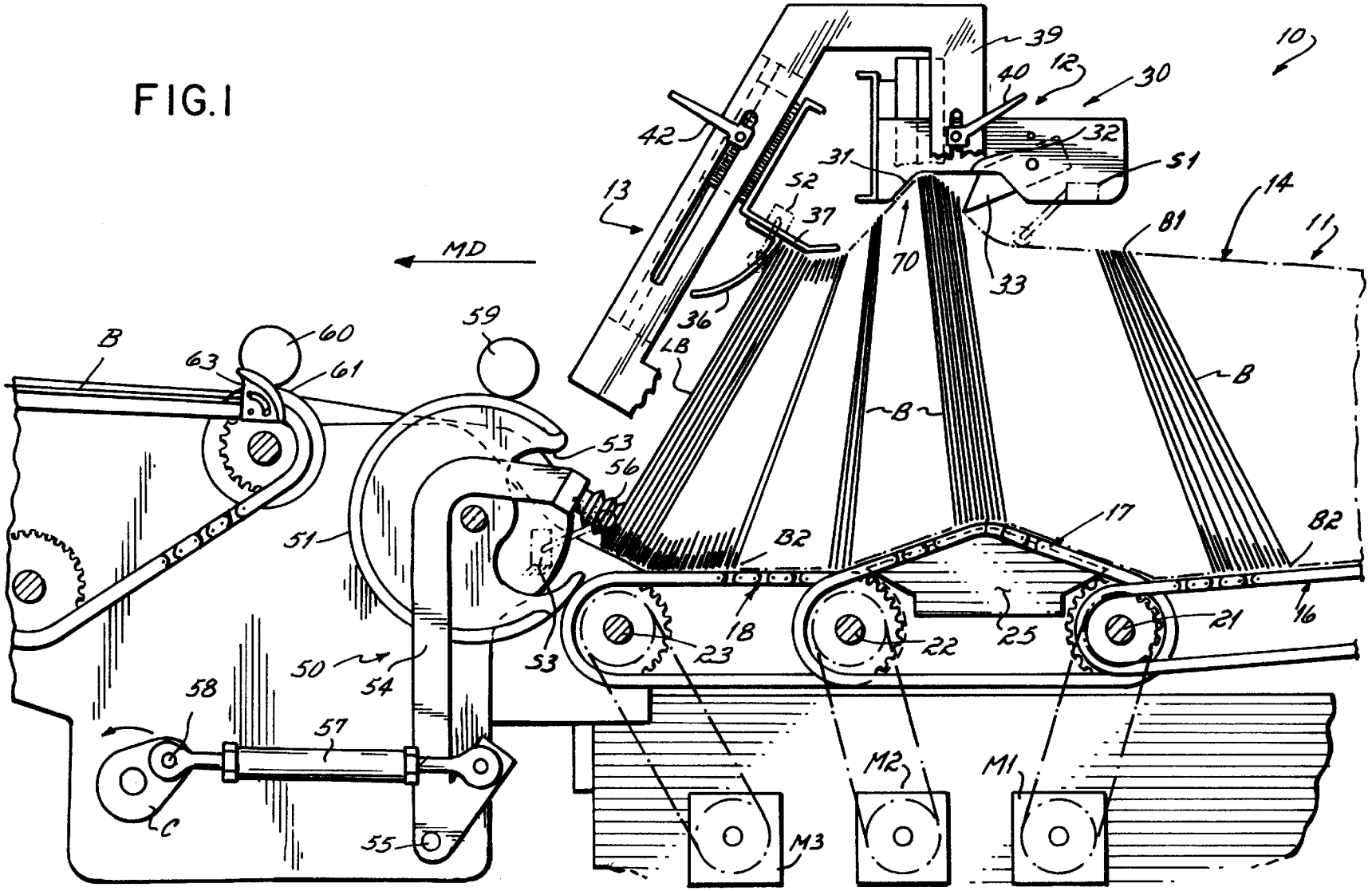

This invention relates to cartoning apparatus and more particularly to apparatus for receiving and feeding carton blanks in a downstream direction toward a cartoner which erects, fills and seals the cartons.

In handling cartons, it is known to provide a carton feeder for receiving flattened carton blanks in bulk and delivering flat blanks individually to a conveyor or other cartoning apparatus. Such feeders typically include a blank magazine which is oriented either vertically, horizontally or inclined. Flattened carton blanks are delivered in bulk to the magazine, forming a "stack" of blanks. Such stacks generally have a bottom end, from which cartons are picked off, one after the other and a top end against which more flattened blanks are loaded as desired.

In the vertical and inclined magazines, the bottom end of the carton stack is generally the lower end while the upper end of the stack is the top end. In the horizontal magazine, the downstream end of the stack in the machine direction is usually deemed the bottom end while the upstream end of the stack is the top end. In such horizontal magazines, it is not unusual for the blanks to have their respective upper edges tilted toward a downstream direction, i.e. toward the stack bottom. Thus the downstream or bottom end blanks bear the stack pressure from the top end or upstream blanks leaning against them. When a carton is picked off the downstream or bottom end, it must be handled in a way to differentiate it or separate it from the stack. This is sometimes accomplished by pick-off mechanisms comprising escapements, or the like, with fingers holding the stack while a suction cup or a gripper pulls off the bottom-most blank.

Of course, the steeper or more vertically oriented the stack, the higher the pressure exerted by the stacked blanks on the bottom-most blanks requiring substantial control and "hold-back" mechanisms, for all but the blank being released. Depending on the flexibility and size of the blanks, these devices either unduly interfere with free release of the bottom-most blank, or permit undesirable release of following blanks. Large flimsy blanks, for example, could fall through short hold-back fingers.

This invention comprises an improved feeder primarily configured in a horizontal or other slightly inclined magazine, where nevertheless the stack of cartons usually leans with upper edges forwardly so that the stack weight leans on or is coincident on the lower cartons of the stack's forward or bottom end. This pressure ordinarily complicates the removal of a bottom-most carton for feeding one after the other.

The invention contemplates the handling of the stack to redefine the stack dynamics and pressures exerted by the stack on the cartons therein. In other words, the invention contemplates reorientation or reversal of the stack or its dynamic configuration so that stack pressures are not exerted on the so-called bottom-most carton blanks ready to be fed. This enables use of a much simpler and less costly pick-off mechanism without concern over multiple carton releases due to stack or feed pressures or use of detailed pick-off devices or escapements. At the same time the stack dynamic is retained at the stack top or supply end so further blanks are easily loaded.

To these ends, the invention contemplates a generally horizontal or inclined magazine holding carton blanks with upper edges leaning forwardly in a machine or a feed direction where they pressure downstream carton blanks. Nevertheless, proximate the position where carton blanks are picked off, the dynamic nature of the stack is changed. Specifically, the tops of the cartons are stabilized or confined in a choke or standing wave acting like a choke, while the bottom edges of the cartons are driven through a greater linear distance than the carton's top edges. This creates a form of standing wave in the carton blank stack producing several cartons at the forwardmost or bottom end of the stack now inclined with their upper edges rearwardly.

In other words, the inclinations and thus the dynamics of the stack are reversed, thus relieving the leading or forwardmost carton from all upstream generated pressure forces exerted by leaning cartons.

Since the carton top edges of a few cartons now at the stack's downstream end are so inclined rearwardly, there is no undesirable stack pressure on the downstream-most carton ready for pick off. Pressures exerted by it on the stack are no more than pressures exerted by the stack rearwardly toward the last-loaded blank at the so-called stack top.

As a result, if the entire load of the cartons in the feeder is considered from the downstream-most carton ready for pick-off rearwardly through the last carton in the advancing stack at the stack top, then the stack has one top end at its upstream position and another downstream-most end where the cartons there are not affected by pressures of cartons stacked upstream, and thus also comprises a "top" end. Thus the entire load or stack of cartons in the feeder has two top ends from the standpoint of carton condition as a function of stack pressure, both of which facilitate a function such as top loading (cartons inclined forwardly) or top feeding (cartons inclined rearwardly).

Accordingly, carton blanks can be fed to the stack top in the magazine and individual cartons can be removed from the other end of that stack, which by virtue of the interim dynamic stack reversal also functions as if it were at the "top" of the stack (i.e. bearing no pressure from the weight of cartons above or upstream of it).

In this manner, simple suction cup/segmented wheel pick-off or other mechanisms can be used without undue concerns of feed or stack pressures ramming proximate cartons out the discharge to the pick-off mechanism and jamming it.

In a preferred embodiment of the invention, a carton magazine comprises a first set of two parallel running carton supporting and conveying chains. Cartons are deposited perpendicularly across these with lower edges on the chain and upper edges inclined forwardly of the lower edges. Each carton bears the weight of upstream cartons leading on or toward it.

At a "stack reversal" station, the upper edges of the cartons are restrained at a choke point, preferably by a forward stabilizer, and the lower edges driven onto a second set of two further parallel running chains, preferably slightly inclined upward then declined downwardly. This second set of chains runs faster than the first set so the bottom of the cartons are carried a linear distance longer than the tops, thus reversing their inclination so the top carton blank edges trail the lower edges (i.e. blanks now lean rearwardly).

Thereafter, a third set of parallel running chains conveys the cartons forwardly toward a pick-off point, the lead carton being free of the weight or pressure of succeeding cartons.

Each set of conveyor chains is driven by an independent motor or servo, each of which is controlled at least in part by a respective sensor. A first sensor controlling the first motor for the first set of magazine chains is disposed at the upper edges of the cartons just prior the choke or "wave" area. If the stack is too inclined, so the blank tops do not trip the sensor, the first motor is energized to feed more blanks.

A second sensor is located to sense carton blank top edges downstream of the choke. If the top edges decline too low, the second sensor trips to energize the second motor to drive the second set of chains to drive more cartons through the reversal station.

A third sensor is oriented at the bottom of the cartons at the discharge or pick-off station. If insufficient cartons exist to operatively engage this sensor, it energizes the third motor to drive the third set of chains to supply more cartons to the pick-off station.

Of course, the servos could be controlled by proportioning sensors to operate at varying speeds within preset parameters, but the on/off sensor operation described above is useful. Also, algorythms could be provided to control motor speeds or operation to produce a desired effect.

Moreover, the "choke" of the carton blanks in a reversal station can be by mechanism obstruction such as a stabilizer as shown, or, alternately, simply comprised of what appears to be an unconfined standing wave corresponding somewhat to a position over the inclined, declined second set of chains.

Thus, the benefits of loading a carton magazine at the top end are maintained while feeding off the "top" of the stack, from a functional standpoint, is provided to make the feed and carton pick-off more reliable by eliminating carton weight and pressure at the pick-off station. Thus, the top-load, top-feed feeder provides a useful, unique and improved feeder which can also accommodate both CMH and CMC cartoner operation.

Also, such a feeder more readily accommodates larger, flimsier carton blanks which may otherwise fall through an escapement or edge hold-back mechanism at the discharge end.

It is also contemplated that apart from blanks, the invention could easily be used to feed other diverse materials such as sheets, CDs, discs, plates, planar or nestible objects or the like.

Figure 2:
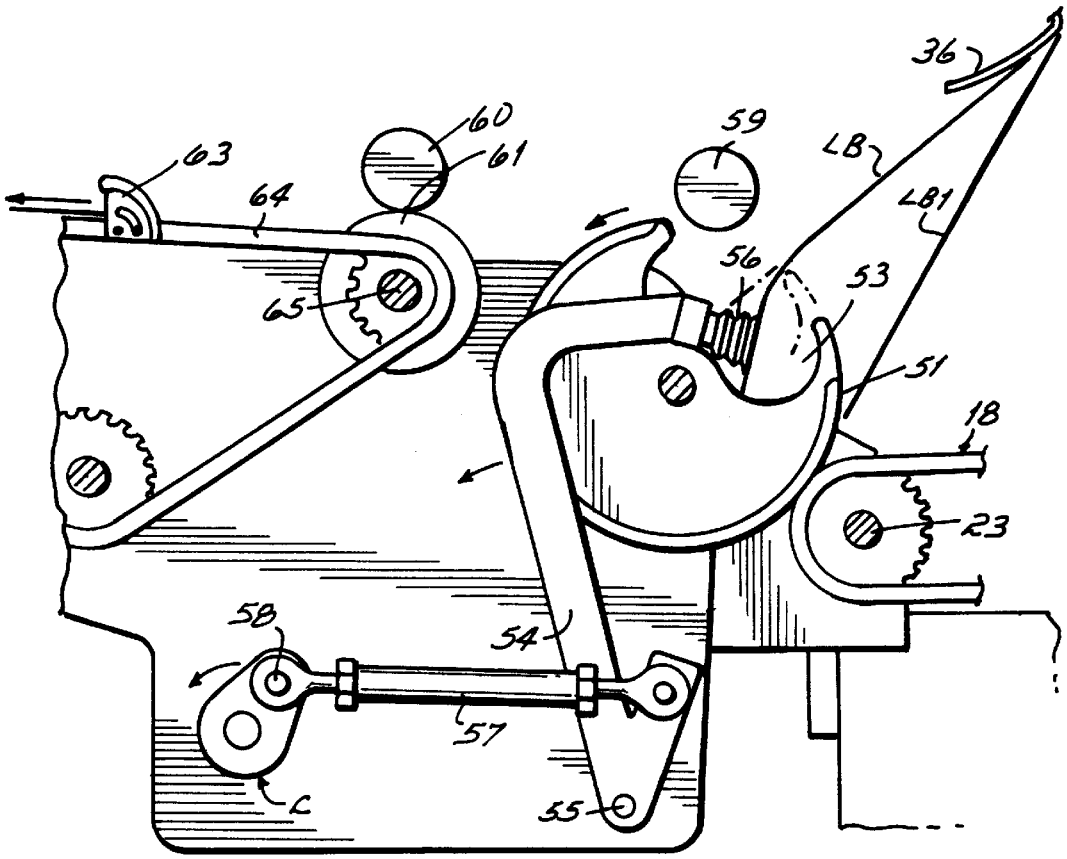
Figure 3:
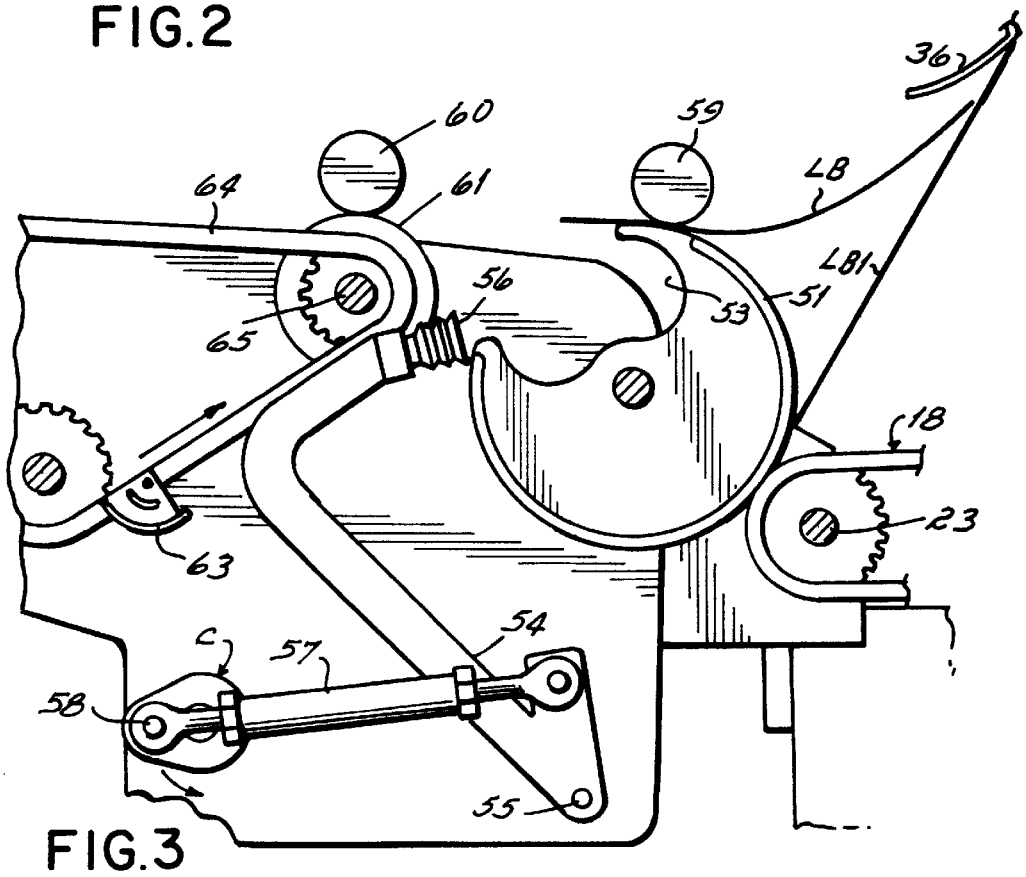
Figure 4:
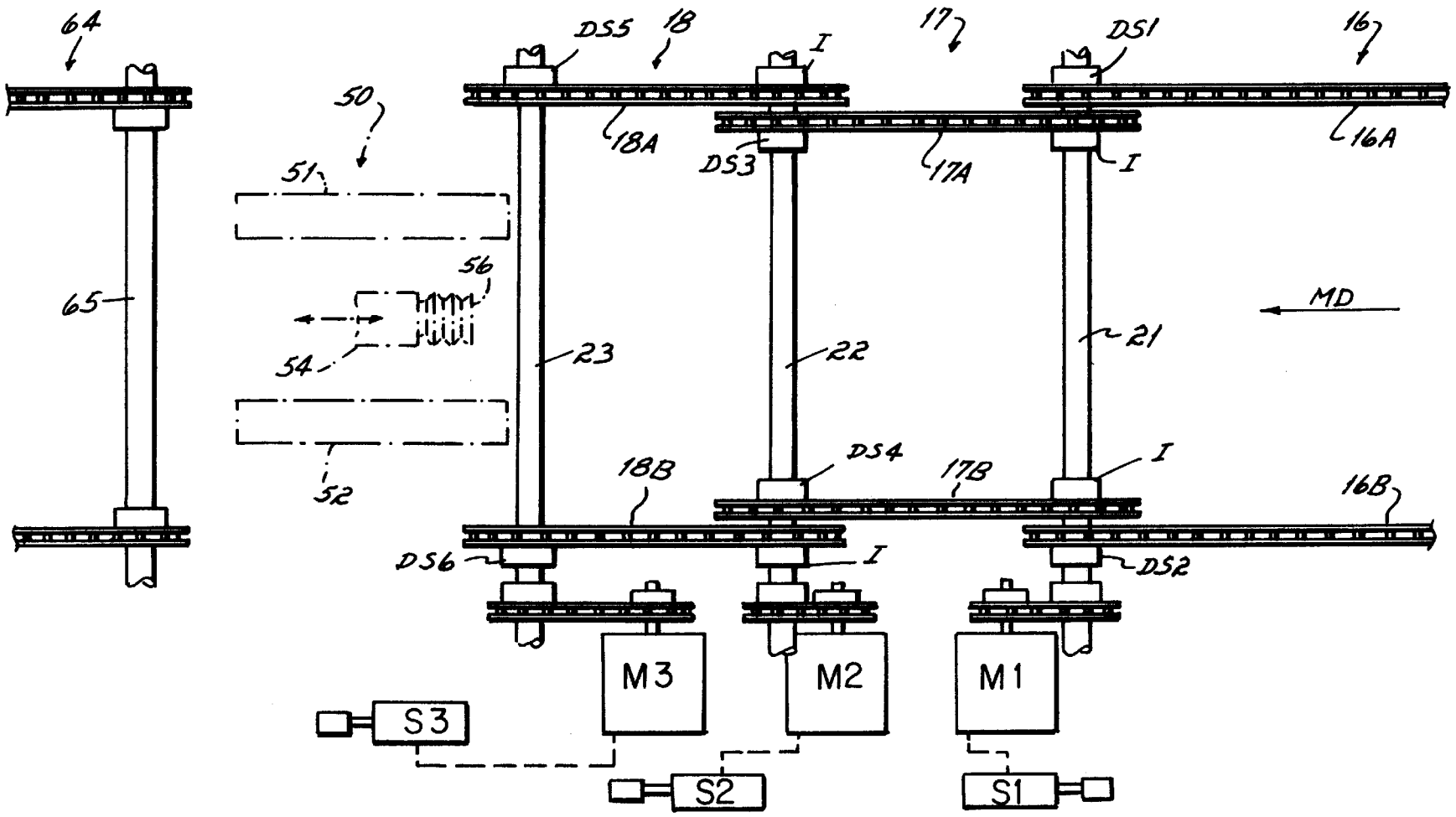

These and other objectives and advantages will become readily apparent from the following detailed description and from the drawings in which:

FIG. 1 comprises an elevational diagrammatic view showing the various components and operation of the invention;

FIG. 2 illustrates the initial pickoff of a carton blank from a stack of blanks according to the invention, and shows the bottom of a downstream-most blank being initially removed from the blank stack;

FIG. 3 illustrates the structure of FIG. 2, having picked off a downstream-most blank and with that blank now secured in a nip for removing the blank, one at a time, from its next adjacent upstream blank and conveying it downstream for further cartoning procedures; and FIG. 4 is a plan view of the various conveyors utilized in the apparatus, as well as a diagrammatic plan view of the carton pickoff station, the sensors and the prime movers utilized in the invention.

Turning now to the drawings, there is illustrated in FIG. 1 a feeder 10 according to the invention. The feeder 10 includes a magazine section 11, a reversing station 12 and a carton pick off station 13.

In essence, a stack 14 of blanks B is deposited into the magazine section or station 11 for downstream feeding in the machine direction MD. As shown in FIG. 1, this magazine station has a slight forward incline downwardly, however, the magazine section 11 could be horizontal or at some other inclination.

In this regard, it is believed preferable to maintain the blanks B with their top edges B1 inclined forwardly in a downstream direction with respect to the machine direction MD and with respect to their bottom edges B2. This renders the magazine section much easier to fill with succeeding blanks at the top end of the stack to form the blank stack 14.

If the blanks were inclined rearwardly in the magazine section 11, the blank stack would have to be supported at the right-hand or upstream-most end of the stack, during the time in which additional blanks were loaded into the magazine. If not, they would simply fall rearwardly. By inclining the blanks B forwardly, as shown in FIG. 1, that is with the upper edges to the left, it is not necessary to restrain the stack 14 for loading further blanks at the upstream-most end of the stack.

At this point, it should also be noticed that the blank stack, or at least this portion of the blank stack, has a top end which is defined by the blank in the right-hand or upstream-most position. This blank does not bear any weight of other blanks on which it rests. The next-most blank in the stack, for example, would simply bear some proportion of the weight of the upstream-most blank and so on, through the stack, so that the stack is operated on by the pressures of the various blanks being conveyed one against the other in a downstream or MD direction as viewed in FIG. 1.

At the reversing station 12, the inclinations of blanks in the stack are reversed. This is accomplished by a separation of the bottom edges B2 of the blanks, at a faster rate than the top edges B1 are conveyed downstream. Thus, the top edges B1 of the blanks in the reversal station are inhibited or choked, so that the bottom edges can be separated by a faster moving conveyor, as will be further described.

This causes a reversal of the inclination of the blanks, as shown in FIG. 1, so that the blanks are now inclined with their top edges rearwardly of their respective bottom edges. Accordingly, now the downstream-most blank in the stack 14 is functionally equivalent to a top blank. That is, it bears no weight by gravity of blanks which succeed it. Instead it is, in effect, the top blank insofar as gravity is concerned, at the discharge station 13.

At the discharge station 13, the downstream-most blank can thus be removed and it is not necessary to use detailed escapement mechanisms which might otherwise be required to hold back the weight of the stack if its dynamics had not been changed by the reversal station through the reversal of blank inclination.

Having very briefly described the operation of the feeder, it will be appreciated that the feeder has a number of components, including respective first, second and third conveyors 16–18, each independently driven by first, second and third motors or prime movers M1, M2 and M3. These could be on/off, constant speed electrical motors or could be servos or hydraulic motors, or any other suitable form of prime mover.

The invention also includes three sensors, S1, S2 and S3, oriented as shown in FIG. 1. As diagrammatically illustrated in FIG. 4, each of the sensors is connected to a respective motor, so that sensor S1 is connected to prime mover M1, sensor S2 is connected to prime mover M2 and sensor S3 is connected to prime mover M3.

It will be appreciated that any suitable form of sensor compatible with the prime mover could be utilized, thus the sensor could be electronic, hydraulic or it could be fiber optically oriented, or any other suitable form of sensor and interconnection could be used with the prime mover.

As illustrated in FIG. 4, the conveyors 16, 17 and 18 operate on somewhat common shafts. Conveyor 16 is driven by prime mover M1, which is connected to a shaft 21, prime mover M2 is interconnected to drive the shaft 22 of conveyor 17 and prime mover M3 is interconnected to drive the shaft 23 of conveyor 18.

Conveyor 16 comprises a pair of parallel chains 16A and 16B attached to drive sprockets DS1 and DS2. Conveyor 17 is likewise comprised of a pair of chains 17A and 17B, which are driven by sprockets DS3 and DS4, and which are locked to receive rotational motion from the driveshaft 22. Driveshaft 23 is connected to sprockets DS5 and DS6, which are interconnected to drive the conveyor 18 when the shaft 23 is rotated.

Thus it will be also appreciated that the conveyor 17 is provided with idler sprockets, I, which simply are mounted on but are rotational with respect to shaft 21. Conveyor 18 is also provided with idler sprockets, I, which are connected to, but are rotatable, with respect to shaft 22.

Accordingly, prime mover M1 drives first conveyor 16, prime mover M2 drives second conveyor 17 and prime mover M3 drives the third conveyor 18. As noted above, preferably the sensors S1, S2 and S3 are simple on/off sensors. When the sensors sense the absence of blank as will be described, the respective prime movers to which they are attached are energized or operated to drive the respective conveyors to which they are attached.

When the sensors do sense the presence of a blank in the position in which they are mounted, they signal each of the respective prime movers to stop operation and thus the respective conveyors to which the prime movers are attached are stopped.

It will be appreciated as this description is further carried out, that other forms of drive and control mechanisms could be utilized. For example, algorythms could be provided to drive and control the prime movers or the servos, such that optimum stack conditions are maintained in the feeder. Thus, blanks could be fed through the magazine section or station 11, into the reversal station where the inclinations are reversed and to the pickoff station 13, all by means of prescribed algorythms and other controls. Nevertheless, the on/off method and apparatus as discussed above has proved to be suitable for feeding, according to one embodiment of the invention.

Briefly describing the second and third conveyor 17 and 18, each comprise a parallel chain run, such as at 17A, 17B and 18A, 18B. However, it will be further appreciated that on each side of the conveyor 17, an inclined support, such as that at 25, is provided to raise the change of the run 17A, 17B upwardly, and then to allow them to decline downwardly, so that a hump is provided in the pathway of the blank bottoms.

It will further be appreciated that the prime movers are controlled to operate the respective conveyors to which they are attached at different speeds. For example, prime mover M1 may drive the conveyor 16 at a speed corresponding to approximately 8 rpm. The second prime mover M2 may be constructed to drive the second conveyor 17 at a speed corresponding to 12 rpm, while the third prime mover M3 is constructed and interconnected to drive the third conveyor 18 at a speed which has a function of about 18 rpm.

Accordingly, each of the conveyors in one aspect of the invention runs at 50% faster than the preceding conveyor. Other speeds, of course, could be utilized and provided by different gearing, algorythms, and different prime mover operations.

It will thus be appreciated that as the forwardly-inclined blanks B move forwardly in stack 14 to the reversal station, the bottom edges B2 are engaged by the conveyor 17 and, because it runs faster than the preceding conveyor 16, the bottom edges B2 of the blanks are separated and moved through the reversal station at a linear speed which is faster than the tops B1 of the blanks B are allowed to move through the reversal station.

To this end, and in one embodiment of the invention, a stabilizer choke 30 is provided. The choke 30 includes an inclined surface 31 which operates to impede the forward motion of the blanks B, a choke duration section 32 and a pivoted backstop or rear stabilizer 33.

It will be appreciated that the pivoted backstop 33 can be pivoted in a clockwise manner to allow the passage of blank top edges B1 thereby, however, the pivoted backstop 33 also acts to prevent the top edges of the blanks from falling rearwardly, in the event that the stack pressure tends to be light, or that there are too few blanks in the stack 14 and in the magazine section 11, to maintain enough forward pressure on the blanks B to keep them from falling rearwardly.

As the blanks are conveyed by the conveyor 17, then the bottoms are separated by virtue of the greater speed of that conveyor as compared to the speed of the conveyor 16 and, as well, the blanks are somewhat raised into the choke area between the surface 31 and the backstop 33, allowing the blank bottoms to not only be separated, but to be driven forwardly at a speed which exceeds the speed at which the tops of the blanks move. This velocity differential is facilitated in this embodiment by the stabilizer surface 31.

As the blanks continue to be conveyed by the conveyor 17, the now-separated bottoms are eventually engaged by the conveyor 18. This conveyor moves, again, relatively faster than the conveyor 17, such that the blank bottoms are again urged toward one another while, at the same time, the tops may be still partially restrained, either by the surface 31, or by the pressure of the adjacent blank tops.

Through this process, it will be appreciated that the tops of blanks in the stack 14 in the reversal station 12 and in the discharge station 13 remain in contact with one another. Thereafter, the conveyor 18 drives the bottoms B2 of the blanks together into the pickoff station 13.

At the pickoff station 13, there is a deflector 36 which engages the tops of the blanks and simply holds them in a position so that they may be picked off, one after the other, by the pickoff mechanism, which will be further described.

It will be appreciated that the choke 30 is mounted on a frame member 39 secured to an adjustable mechanism illustrated by the lever 40, so that it can be adjusted vertically, as is desired.

Moreover, the deflector 36 and the guide surface 37 for the top edges of the blanks can be adjusted with respect thereto by the same mechanism. It will be appreciated that another adjustable mechanism represented by the handle 42 is also provided for yet finer tuning of the choke 30, so that the feeder 10 can be easily adjusted to accommodate blanks of varying dimensions.

It will be appreciated that the sensor S1 is mounted on the choke 30, as shown, in a position to engage the top edges B1 of blanks therein. Should the stack 14 become too inclined forwardly, so that the top edges B1 of the blanks do not engage this sensor, the sensor trips to drive the prime mover M1 and thus the conveyor 16 to further pressure the supply of blanks toward the reversal station 12 and to help erect the stack so that the top edges do engage the sensor. This condition, for example, might occur where there are too few blanks in the stack 14 to maintain the desired inclination going into the reversal station 12.

Sensor S2 is mounted on or just above the guide surface 37 and has a depending arm, as shown, to engage a top portion of blanks just beneath the top edge of the blanks at that position in the discharge station. Should no blanks be sensed, this could be indicative of a situation where there are too few blanks at the station and, in such a situation, sensor S2 would operate the prime mover M2 to drive the second conveyor 17 to supply further blanks through the reversal station 12 and to the discharge station 13.

Finally, the sensor S3 is positioned to engage a bottom portion of the blanks near the bottom edges B2 at the discharge station. Should insufficient blanks be present here, the sensor would sense that condition and would energize the prime mover M3 to drive the third conveyor 18 to supply further blanks up into that station.

Accordingly, the sensors, by driving the respective conveyors, serve to maintain an appropriate prime of blanks into the choke station or the reversal station 12 (Sensor S1), while the sensors S2, through driving conveyor 17, and S3, through signaling the prime mover for the conveyor 18, insure that there is sufficient blanks and sufficient orientation at the discharge station as is desired.

Turning now briefly to the pickoff station 13, it will be appreciated that there is disclosed a blank pickoff mechanism 50 clearly illustrated at the lefthand side of FIG. 1 and in FIGS. 2 and 3. This pickoff mechanism includes, in this embodiment, among other things, two segmented wheels 51, 52, each of which has a segmented opening, such as at 53.

A pickoff arm 54 is pivoted to 55 and has a blank gripping suction cup 56 thereon. An actuating arm 57 is connected through a crank driven (crank C) pin 58 to reciprocate the arm 54 in an arcuate manner, pivoting it around the pivot 55, in timed relation to the segmented wheels 51, 52.

When in the condition shown in FIG. 1, the suction cup 56 is engaging the bottom portion of a leading-most blank, such as the blank LB shown in FIG. 1. That blank has its top edge inclined rearwardly of its bottom edge with respect to the machine direction MD, so that there is no pressure on this blank exerted by the weight of the succeeding blanks. There may be some slight conveyed pressure exerted on this blank by the operation of the conveyor 18 on succeeding blanks behind it, but that pressure is insufficient to cause the next most-leading blank immediately behind the blank LB to pop out or extend from the pickoff station.

An intermediate position of the apparatus 50 is shown in FIG. 2. Here the suction cup 56 and the arm 54 have been reciprocated to the left to pull off the bottom edge of the blank LB into the segmented area 53 of the segmented wheel. The blank LB is thus pulled by its bottom away from the next-most leading LB1 and from the stack 14, with the bottom-most edge B2 of the blank LB residing within the segmented area of the wheel.

Thereafter, as the wheel continues to rotate, the blank is moved to the position as shown in FIG. 3, where its bottom edge has been lifted by the edge of the opening S3 and captured between the outer surface of the segmented wheel 52 and the nip wheel 59.

In this position, the nip formed by the wheel 59 and the segmented wheel 52 drives the blank LB forwardly or to the left, as viewed in FIG. 3. What was the bottom edge B2 of the blank LB is moved toward the nip formed by the nip wheels 60, 61 and further onto the conveyor 64 for conveying or transporting the blank toward a downstream position for erection and filling as a carton.

Once more dogs 63 are mounted on conveyor 64 and will then drive what had been the top edge B1 of the blank, and therefore the entire blank, to the left as viewed in FIGS. 2 and 3.

Thereafter, the segmented wheels 51, 52 continue their rotation and the arm 54 moves forwardly to again engage a succeeding blank, this time LB1, for removal, and so on.

It will be appreciated that the conveyor 64 is mounted about a shaft 65 with various suitable sprockets and any other attachments. It will be appreciated in FIG. 3 that the arm 64 and the suction cup 56 are withdrawn substantially below the plane of the path of travel for the blanks B as they are engaged by the nips formed at 59, 52 and 60, 61.

Thereafter, the arm 54 is actuated by the actuating arm 57 and pin 58, to move again to the right or in a clockwise direction for engagement of a subsequent blank.

Accordingly, it will be appreciated that the invention contemplates and provides a top load, top feed, carton blank feeder. The phrase "top load" refers to the loading of the multiple carton blanks into the magazine section 14, where the loads are provided against what is the topmost blank in the stack at the period of time when the load is made.

Thereafter, the upstream-most blank, that is the blank furthest to the right as viewed in FIG. 1, would become the top blank in the stack. By means of the reversal station 12, the dynamics of the stack 14, however, are significantly changed. That is to say that the angle of inclination is changed from a forward inclination to a rearward inclination. Thereby after the blanks have passed through the reversal station 12, the left-most or downstream-most blank becomes the top blank in a stack and therefore the phrase "top feed" relates to the removal of the top-most blank LB from the stack 14. Thus, the stack in actuality, as described, has two top ends, one to the right and one to the left. The phrase "top feed" thus refers to removal of the downstream-most blank as if it was an end-most blank on the top of a stack, i.e. without significant succeeding blank pressure.

It will also be appreciated that the angle of orientation of the blanks move through the vertical. That is, the blanks inclined in the magazine section are inclined forwardly at one angle with the vertical, and when the angle of inclination is reversed, the blanks are rotated through the vertical to another angle with the vertical, where they reside in the pickoff station 13.

This invention provides for handling of many different sizes of blanks and many different blank parameters. For example, even very flimsy blanks can be handled without fear of the blanks popping out of a gripper finger or the like, such as at a removal station where succeeding blank pressure or the mere flexibility of the blanks may cause them to bow and simply fall out of the discharge station.

Moreover, it will be appreciated that the choke or stabilizer 30 provides the means by which the upper edges of the blanks are retarded, while the bottom edges are separated and move further to cause the inclination reversal. It may also be possible, through control of the various drives or servos, simply to create, by this mechanism and without the choke, a standing wave in the top edges of the blank, such as illustrated at 70, and without the actual need to engage the top edges of the blank, other than perhaps to have a holdback device.

It will also be appreciated that other mechanisms and processes could be used to reverse the inclination of the blanks. For example, blanks could be stripped from a supply stack leading forwardly and re-fed and inserted into a rearward leaning discharge stack.

These and other objectives, advantages and modifications will become readily apparent to those of ordinary skill in the art without departing from the scope of the invention, and the applicant intends to be bound only by the claims appended hereto.

What is claimed is:

1. A method of handling blanks, including moving a stack of blanks in a downstream direction to a position where leading blanks are fed seriatim one-by-one from said stack, said method further including the steps of:

depositing blanks in a magazine such that said blanks form a stack with blank top edges inclined forwardly into a downstream direction;

conveying said stack downstream toward a choke;

conveying top edges of blanks past a back stop of said choke and restricting motion of said top edges in an upstream direction, with said back stop:

shifting said blanks in said stack such that bottom portions of the blanks are separated and thereby reorienting said blanks such that said top edges now incline rearwardly toward an upstream direction;

moving bottom portions of blanks in said stack together, said blanks remaining in a rearwardly inclined disposition, and picking off blanks from said stack seriatim by removing one downstream-most blank at a time from said stack.

2. A method of loading and of feeding carton blanks comprising the steps of:

depositing an indefinite number of blanks on a first conveyor defining in part a blank magazine, said blanks having top edges being inclined forwardly of trailing bottom edges;

driving said first conveyor in response to a control signal to convey blanks in a downstream direction toward a choke;

transferring blanks onto a second conveyor and conveying said top edges past a back stop of said choke, said back stop restricting motion of passed top edges rearwardly toward an upstream direction;

conveying bottom edges of blanks, whose tops have passed said back stop, on said second conveyor downstream of respective top edges thereof so that top edges trail now leading bottom edges;

conveying said blanks onto a third conveyor;

removing leading blanks from said third conveyor.

3. A method as in claim 2 wherein the step of driving said first conveyor includes sensing blank top edges downstream of said first conveyor and deriving said control signal from said sensing.

4. A method as in claim 2 including the step of conveying said blanks on said second conveyor with a component of motion in a vertical direction.

5. A method as in claim 2 including driving said second conveyor in response to a control signal derived from a blank top edge sensor disposed at a location downstream of said second conveyor.

6. A method as in claim 5 including the step of driving said third conveyor in response to a control signal derived from a blank bottom edge sensor disposed proximate a downstream discharge end of said third conveyor.

7. A process for feeding items including the steps of:

depositing items in a stack such that the items are inclined at an incline angle in a forward direction;

moving items in said forward direction;

moving tops of items downstream past a back stop;

reversing the incline angle of at least one item so it inclines rearwardly;

collecting rearwardly inclined items downstream of said back stop; and feeding items from a downstream end of collected rearwardly inclined items.

8. A process as in claim 7 including restricting forward motion of trailing top edges of items while feeding items from said downstream end of collected rearwardly inclined items.

9. A process as in claim 7 including the depositing step of depositing an indefinite number of items in said stack upstream of said back stop.

10. A process as in claim 9 including conveying said items on three distinct conveyors, sensing portions of items at three distinct locations and driving said respective conveyors in response to said sensing steps at said distinct locations.

11. A process as in claim 10 including driving each conveyor in response to a lack of sensed items at a respective distinct location and stopping each conveyor in response to a presence of sensed items at a respective distinct location.

12. A method of feeding items including the steps of:

depositing a stack of items in a magazine, wherein each item includes a respective top edge and a respective bottom edge;

conveying said item stack in a first forward direction;

conveying top edges of items past a back stop and restricting respective top edges of items against motion in a rearward direction, opposite to said first direction, with said back stop;

thereafter conveying bottom edges of said items in said stack faster than respective top edges so the top edges trail the respective bottom edges with respect to said first direction; and thereafter removing items one at a time from said stack beginning with the downstream-most item with respect to said first direction.

13. A method as in claim 12 wherein said depositing step includes depositing an indefinite number of items in said magazine.

14. A method as in claim 12 including the step of supporting all pressure exerted by any trailing top edges of said items with said back stop.

15. A method as in claim 12 including the step of lifting items passing said back stop in an upward direction by conveying the bottom edges of said items upwardly.

16. A method as in claim 15 including the steps of restricting forward motion of top edges of said items in said forward direction while picking off an item from said stack by pulling said item toward said first direction from a bottom portion of said item proximate its bottom edge.

17. A method as in claim 12 wherein said top edge conveying step includes conveying said top edges of said items past a back stop which is fixed against motion in said first forward direction.

18. A method as in claim 17 including restricting motion of top edges of said items past said back stop from motion in said first forward direction.

19. A method as in claim 12 including:

conveying said items on first and second independent conveyors at different velocities to separate bottom edges of said items so they lead their respective top edges;

thereafter conveying said items on a third independent conveyor to urge said leading bottom edges together;

and further including the steps of:

sensing the presence of top edges of items upstream of said back stop and driving said first conveyor faster in response to a lack of sensed top edges.

20. A method as in claim 19 comprising the further steps of:

sensing top edges of said items downstream of said back stop and driving said second conveyor in response to a lack of sensed top edges downstream of said back stop.

21. A method as in claim 20 including the steps of sensing bottom edges of said items downstream of said second conveyor and driving said third conveyor in response to a lack of sensed bottom edges.

* * * * *